US009636711B2

(12) United States Patent
Benjamins

(10) Patent No.: US 9,636,711 B2
(45) Date of Patent: May 2, 2017

(54) SHAFT FOR A ROTARY STAR SCREEN CONVEYOR ROTOR AND ROTARY STAR SCREEN CONVEYOR INCLUDING SUCH SHAFTS

(71) Applicant: BOLLEGRAAF PATENTS AND BRANDS B.V., Appingedam (NL)

(72) Inventor: Jan Benjamins, Elim (NL)

(73) Assignee: BOLLEGRAAF PATENTS AND BRANDS B.V., Appingedam (NL)

( * ) Notice: Subject to any disclaimer, the term of this patent is extended or adjusted under 35 U.S.C. 154(b) by 0 days.

(21) Appl. No.: 14/861,516

(22) Filed: Sep. 22, 2015

(65) Prior Publication Data

US 2016/0082477 A1 Mar. 24, 2016

(30) Foreign Application Priority Data

Sep. 22, 2014 (EP) ..... 14185835

(51) Int. Cl.
*B07B 1/15* (2006.01)

(52) U.S. Cl.
CPC ..... *B07B 1/15* (2013.01); *B07B 1/155* (2013.01)

(58) Field of Classification Search
CPC ..... B07B 1/15; B07B 1/155
USPC ..... 209/671, 672
See application file for complete search history.

(56) References Cited

U.S. PATENT DOCUMENTS 1,899,292 A 2/1933 Rienks
4,795,036 A 1/1989 Williams
5,425,459 A * 6/1995 Ellis ..... A01D 17/06 209/667
5,590,792 A * 1/1997 Kobayashi ..... B07B 1/155 209/667
5,975,441 A * 11/1999 Burkholder ..... B07B 1/155 241/101.76
7,000,779 B2 2/2006 Smook
7,644,882 B2 * 1/2010 Potts ..... B02C 4/08 241/186.4
8,522,983 B2 * 9/2013 Davis ..... B07B 1/155 209/261
8,573,406 B2 * 11/2013 von Haas ..... B27N 3/14 209/671
8,640,880 B2 * 2/2014 Farwick ..... B07B 1/155 209/671
8,646,615 B2 * 2/2014 Bruggencate ..... B07B 1/15 209/665

(Continued)

FOREIGN PATENT DOCUMENTS

DE 1021200 B 12/1957
EP 1348491 A1 10/2003

(Continued)

*Primary Examiner* — Joseph C Rodriguez
(74) *Attorney, Agent, or Firm* — Pearne & Gordon LLP

(57) ABSTRACT

A shaft for a rotary star screen apparatus has a shaft body having a series of axially spaced star connectors and a series of stars, mounted to the star connectors. Each one of these stars has a plurality of circumferentially distributed star members each elongate in a direction having a component radially away from the shaft body. The star connectors each have a plurality of circumferentially distributed star member connectors. Each of these star members is a separate part, individually and detachably mounted to one of the star member connectors. An apparatus equipped with such shafts is also described.

13 Claims, 4 Drawing Sheets

(56) References Cited

U.S. PATENT DOCUMENTS

| | | | | |
|---|---|---|---|---|
| 8,683,918 | B1 * | 4/2014 | Witham | A23N 12/005 209/673 |
| 8,800,781 | B1 * | 8/2014 | Carlile, Jr. | B07B 1/155 209/671 |
| 8,827,083 | B2 * | 9/2014 | Doppstadt | B07B 1/50 209/671 |
| 9,027,762 | B2 * | 5/2015 | Davis | B07B 1/16 209/672 |
| 9,387,516 | B1 * | 7/2016 | Davis | B07B 1/15 |
| 2003/0183561 | A1 | 10/2003 | Smook | |
| 2008/0105597 | A1 | 5/2008 | Miller et al. | |
| 2009/0114571 | A1 | 5/2009 | Miller et al. | |
| 2010/0264069 | A1 * | 10/2010 | Green | B07B 1/15 209/262 |
| 2014/0202933 | A1 | 7/2014 | Benjamins | |

FOREIGN PATENT DOCUMENTS

| | | | |
|---|---|---|---|
| EP | 2409784 | A2 | 1/2012 |
| EP | 2759348 | A1 | 7/2014 |

* cited by examiner

SHAFT FOR A ROTARY STAR SCREEN CONVEYOR ROTOR AND ROTARY STAR SCREEN CONVEYOR INCLUDING SUCH SHAFTS

FIELD AND BACKGROUND OF THE INVENTION

This invention relates to a shaft for a rotary star screen conveyor rotor and to a rotary star screen conveyor apparatus including such shafts.

Rotary star screen conveyors are employed for sorting small and/or flexible components from larger and/or stiffer components, e.g. for separating potatoes or tree roots from soil, for separating cardboard from paper or for separating large fruit from smaller fruit having large surfaces for effecting a sortation process to remove small size components from larger components.

An example of such a screen conveyor is disclosed in German Auslegeschrift 1 021 200. In this rotary star screen conveyor, outer portions of sorting stars are of rubber material to avoid damaging agricultural products that are being sorted, while more central portions of the stars including hub portions of the stars are of metal.

In U.S. Pat. No. 4,795,036 a rotary disc screen conveyor is disclosed in which each of the shafts is provided with a series of fixed supports such as circumferential rib rings arranged in axially spaced positions and encircling the shaft external surfaces to extend radially outwardly from the shaft. Each of the rib rings supports a disc. The discs are split into semi-circular and complementary disc parts in order to facilitate the mounting or removal of the disc parts.

European patent application 2 409 784 discloses a shaft for a sieve having an octagonal shaft body to which strips are bolted. Each strip extends along the length of the shaft and has a plurality of fingers distributed along the length of the shaft.

U.S. Pat. No. 5,975,441 discloses an apparatus for separating earth from rocks and stones with a plurality of shafts forming a screen conveyor. The apparatus has a spiked roller assembly bed formed from a plurality of longitudinally spaced, parallel spiked rollers operably powered for rotation in the same direction to convey the material. Each shaft includes a shaft member having formed thereon, or integrally affixed thereto, a plurality of transversely spaced mounting collars, to each collar spike member segments or quadrants are detachably mounted. Each spike member segment or quadrant has a plurality of spike members.

U.S. Pat. No. 1,899,292 a screening device with shafts each having a shaft body with square cross-section is disclosed. Agitating members carried by the shaft body are each composed of a hub having a squared opening corresponding with the squared portion of the respective shaft, and slightly resilient curved arms or spokes which are set in equidistant apertures of the hub. The agitating members are fitted loosely on their respective shafts and are slightly spaced apart so that they may move laterally in a wabbling motion.

SUMMARY OF THE INVENTION

It is an object of the present invention to provide a solution that allows quick and easy repair of the star screen in the event of damage to the stars.

According to the invention, this object is achieved by providing a shaft for a rotary star screen apparatus, the shaft having:

a shaft body having a series of axially spaced star connectors; and a series of stars, mounted to the star connectors, each one of the stars including a plurality of circumferentially distributed star members each elongate in a direction having a component radially away from the shaft body;

wherein the star connectors each include a plurality of circumferentially distributed star member connectors; and wherein each of the star members is a separate part, individually v and detachably mounted to one of the star member connectors.

The invention can also be embodied in a rotary star screen apparatus including a screen formed by a co-rotating and spaced parallel plurality of shafts, each of the shafts having:

a shaft body having a series of axially spaced star connectors; and a series of stars, mounted to the star connectors, each one of the stars including a plurality of circumferentially distributed star members each elongate in a direction having a component radially away from the shaft body;

wherein the shafts form a row of shafts, the row being oriented in a direction transverse to the shafts, a rotary contour of at least one star of each of the shafts interleaving in partial overlap with rotary contours of stars of at least one neighboring one of the shafts;

wherein the star connectors each include a plurality of circumferentially distributed star member connectors; and wherein each of the star members is a separate part, individually and detachably mounted to one of the star member connectors.

Damaged star members can easily be replaced individually because the star connectors are each composed of a plurality of circumferentially distributed star member connectors, and each of the star members is a separate part that is individually and detachably mounted to one of the star member connectors. Thus, the costs of replacement parts are reduced, because only damaged star members need to be replaced. Moreover, replacement can be carried out more quickly and easily, because the individual star members are relatively light and therefore easy to handle and easily mountable by an individual mechanic.

Further features, effects and details of the invention appear from the detailed description and the drawings.

DETAILED DESCRIPTION

Figure 1:
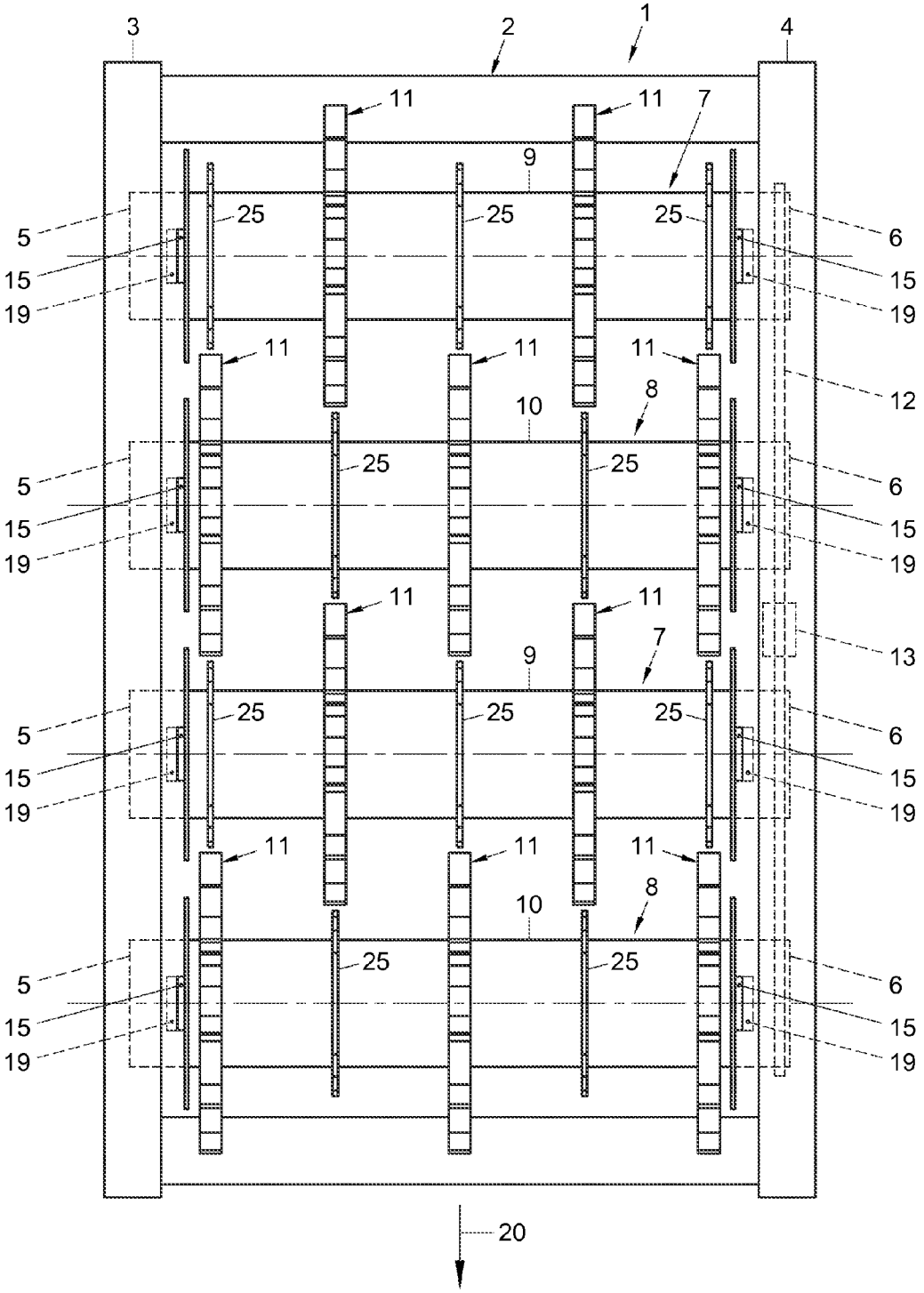
FIG. 1 is a schematic plan view of an example of a rotary star screen conveyor apparatus according to the invention.

In FIG. 1, an example of a rotary star screen conveyor apparatus 1 according to the invention is shown. The apparatus shown in FIG. 1 is of relatively small width and length to allow showing constructional details of the apparatus in a relatively large format. In practice, star screen conveyors generally have a larger number of shafts and a larger number of stars on each shaft. This will also apply to apparatuses according to the present invention.

Figure 2:
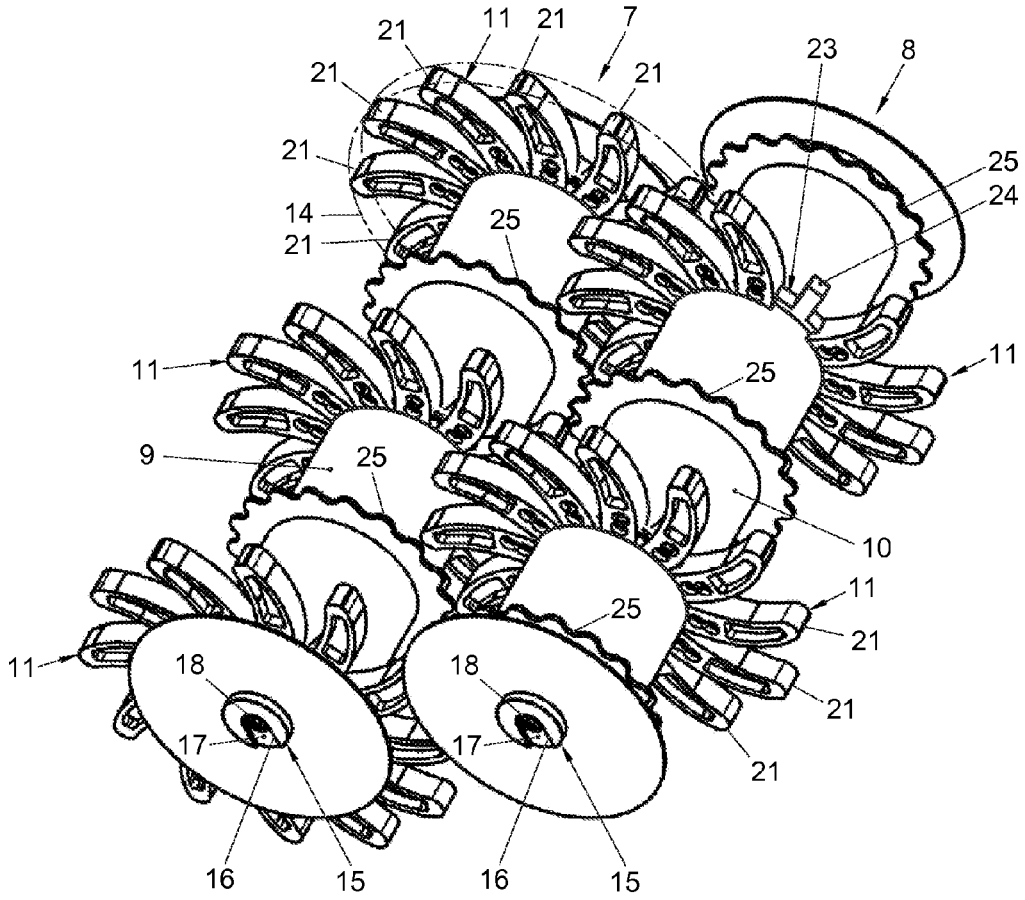
FIG. 2 is a perspective view of two examples of shafts according to the invention in operative positions relative to each other, one of the star members of one of the stars being dismounted.
Figure 3:
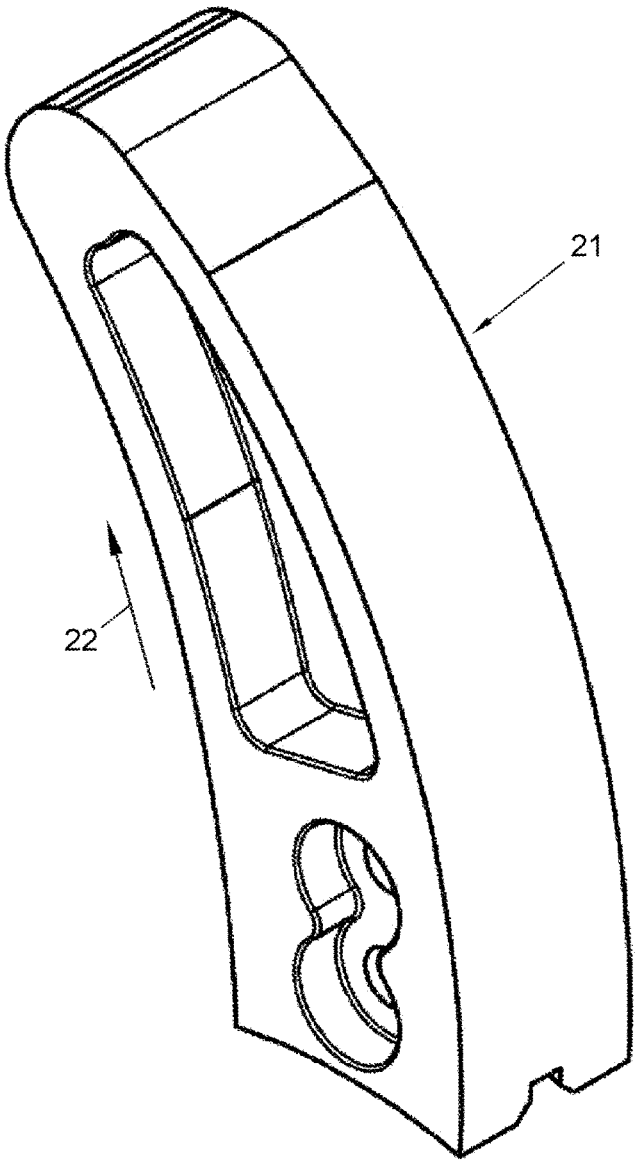
FIG. 3 is a perspective view of an example of a star member of a shaft according to the invention.

The apparatus 1 has a frame 2 with side parts 3, 4 in which hubs 5 and 6 have been arranged, via which shafts 7, 8 are rotatably suspended. The hubs 5, 6 are rotatably suspended to the side parts 3, 4 of the frame 2 via bearings. As is also shown in FIG. 2, the shafts 7, 8 have shaft bodies 9, 10 to which stars 11 are mounted. At the side of the bearings 6 sprocket wheels are mounted to the shaft bodies 9, 10. The sprocket wheels are in engagement with schematically shown drive chain arrangement 12 driven by a motor 13, for driving rotation of the shafts 7, 8 about their respective center line, all in the same sense of rotation.

As is best seen in FIG. 2, to both ends of the shaft bodies 9, 10, first coupling disks 15 are fixed, each having a passage 16 for fitting accommodation of an end portion of a centering pin. The passages 16 each open into a recess 17, which slightly tapers radially to the outside and has a bottom area 18. In FIG. 1, the first coupling disks 15 are each releasably mounted to a second coupling disk 19 of one of the hubs 5, 6. The second coupling disks 19 have a radial thickening of a shape matching the shape of the recess 17 of the first coupling disk 15. The thickenings each snugly fit in one of the recesses 17, in order to bring the first and second coupling disks 15, 19 into coupling engagement with each other for transferring a moment of torque, so that they can form one rotatable unit, the bottom area 18 supports an opposite area of the thickening while, due to the fitting tapering accommodation of the thickenings in the recesses 17, support may also be provided along the side areas that diverge from each other. Further details and effects of suspending the shafts via such coupling disks are disclosed in European patent 1 348 491.

As shown in FIG. 1, the stars 11 of adjacent shafts 7, 8 have been positioned staggered with respect to each other, so that rotary contours (see e.g. rotary contour 14 in FIG. 2) of stars 11 of the neighboring shafts 7, 8 interleave with each other, in partial overlap with each other. This leaves openings bounded by sections of adjacent shaft bodies 9, 10 and adjacent stars 11 that prevent material parts above a maximum size from falling through the screen.

In operation, bulk material or a mix of bulk materials to be separated is dumped on the bed formed by the plurality of stars 11 and the shaft bodies 9, 10. Rotation of the shafts 7, 8 repeatedly throws the dumped material upwards and in a transport direction causing the fine and/or flexible fraction of the material to be separated from the coarse and/or stiff fraction, by allowing the fine and/or flexible fraction. of the material to down between the shafts 7, 8, while the coarse and/or stiff fraction of the material is continued to be advanced in the direction of transport 20 in which the top sections of the shaft bodies 9, 10 and of the stars 11 are moving. However, sometimes material becomes stuck between a star 11 and an adjacent shaft body 9, 10 or between adjacent shafts to such an extent that a star 11 becomes damaged. This can for instance occur when very hard items such as stone or metal items are clamped or when high strength items such as rope or wire material becomes stuck between or around shafts. In such cases, a star 11 can become damaged and needs to be repaired to maintain a reliable separation between fractions of a material to be separated.

Figure 4:
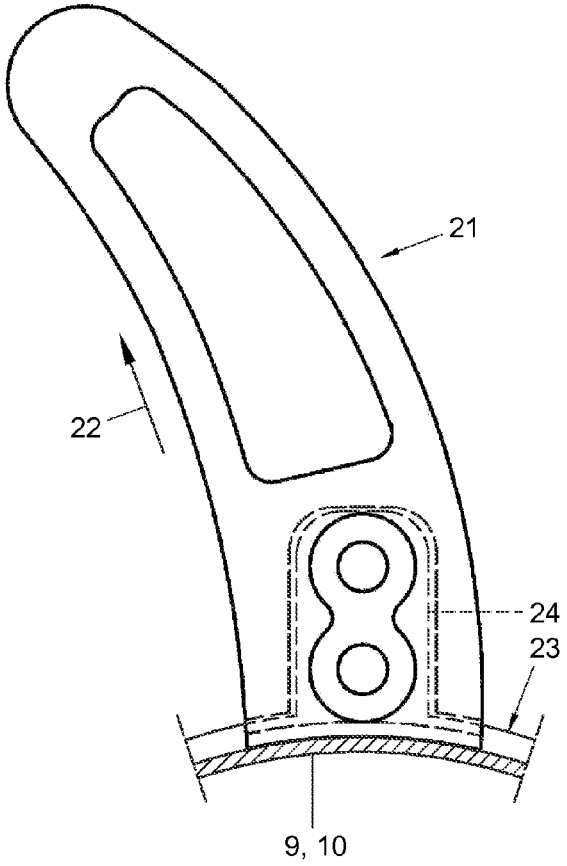
FIG. 4 is a side view of the star member shown in FIG. 3.
Figure 5:
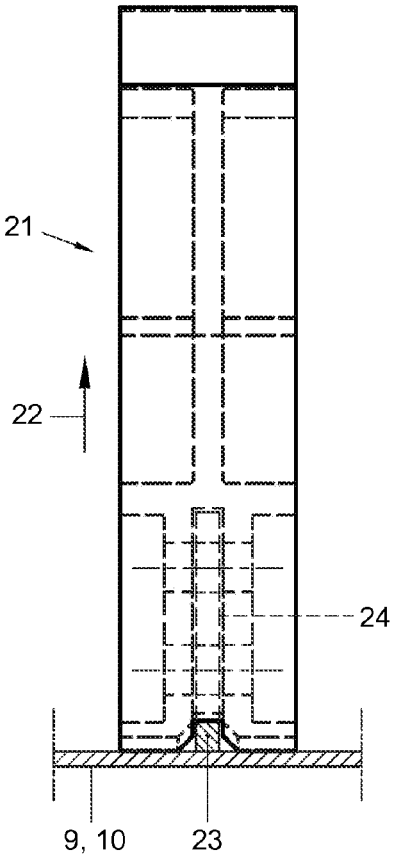
FIG. 5 is a frontal view of the star member shown in FIGS. 3 and 4.

As is illustrated by the example shown in the drawings, the stars 11 each have a plurality of circumferentially distributed star members 21. (in FIG. 2 not all star members are designated by a reference numeral) each elongate in a direction 22 having a component radially away from the shaft body 9, 10 to which the star 11 is mounted. The shaft bodies 9, 10 each have a series of axially spaced star connectors 23. The star connectors 23 each include a plurality of circumferentially distributed star member connectors 24. In the present example, the star connectors 23 are each formed by a ring encircling the shaft body 9 or 10 and having radially projecting mounting plates 24 forming the star member connectors. One of the star member connectors 24 is shown in FIG. 2 at the mounting location of the star member 21 that has been left out in FIG. 2. The star member connector 24 is also shown in FIGS. 4 and 5. Each of the star members 21 is a separate part, individually and detachably mounted to one of the star member connectors 24. This allows star members 21 that are damaged to be replaced individually, which saves costs, because a star member 21 is a substantially smaller spare part than a complete star or half of a star. Also, the star members constitute relatively small spare parts, which can easily be handled and mounted by an individual mechanic, without using hoisting or other lifting equipment.

A further advantage of a star having separate individual star members is that a rupture of one star member does in principle not progress into an adjacent star member, so that damage tends to remain restricted to individual star members.

In the present example, the star member connectors 24 and the star members 21 have bores that are mutually aligned when a star member 21 is mounted to a star member connector 24. This allows the star member to be fixed relative to the star member connector 24 by passing bolts (not shown) through aligned bores and tightening a nuts (not shown) threaded onto the bolts. However, also other mounting principles are conceivable, such as pins with quick release clamps. For easy mounting, the bores in the star member connector 24 may have a threaded interior, so that no nuts have to handled during mounting and replacing of a star member 21. The star member connector 24 are each fully enclosed by material of the star member 21 mounted thereto, so that no metal of the star member connector 24 is exposed and damage to items being sorted due to contact with sharp edges of hard, e.g. metal, material is counteracted.

The invention is particularly advantageous when applied to stars having a relatively large number of individual star members, for instance at least four, five, six, seven or eight individual star members, since in such stars the star members form a relatively small portion of a complete star and the star members of stars having a large number of star members tend to be more slender, and therefore more susceptible to damage.

In the present example, the star member connectors 24 are mutually connected via a ring portion of the star connector encircling the star body 8 or 9. It is however also possible to provide the star member connectors forming a star connector extending around the shaft member in the form of star member connectors that are individually fixed (e.g. welded) to the shaft body, but not connected by portions of the star connector encircling the shaft body. Thus, the star connector does not have to extend around the shaft, body contiguously, but may be formed by a series of individual, circumferentially distributed. mounting members. Such star members connectors may project from the shaft body, as in the present example, but may also be provided in the shaft bodies, for instance in the form of threaded holes in the shaft bodies.

In the shafts 7, 8 according to the present example, each of the star members 21 has an inner end directly adjacent to the shaft body 9, 10. This provides the advantage that the stars 11 do not have to be provided with a hub portion, which adds to the weight of a shaft while not substantially contributing to its bending stiffness. Moreover, the absence of star hubs allows the provision of shaft bodies 9, 10 of a relatively large diameter, which is also advantageous for achieving sufficient bending stiffness of the shafts at a low overall weight per shaft. For this purpose, it is also advantageous that the shaft body 9, 10 is a hollow tube.

The spacings between circumferentially successive ones of the star members 21 extend between circumferentially successive ones of the star members 21 until the shaft body 9, 10. This allows the star members 21 to be of a maximal size in radial direction, which is favorable for minimizing the amount of deformation required to allow the distal end of the star member 21 to be deflected over a given distance by bending of the star members 21 and therefore reduces the susceptibility to damage caused by an enforced degree of deformations as may for instance be caused by a rigid material part stuck between a star 11 adjacent to shaft body 9 or 10.

The star members 11 are each of elastomeric material, so that the star members 21 are relatively flexible and soft. The latter property is also advantageous for avoiding damage to materials being sorted, for instance when sorting an agricultural produce, such as fruit or potatoes.

As is shown in FIGS. 1 and 2, each of the shafts 7, 8 is further equipped with rings 25 projecting radially from the respective shaft 9, 10 and encircling that shaft 9, 10. The rings 25 are each positioned coplanar with a rotary contour 14 of at least one star 11 of a neighboring one of the shafts 7, 8 and preferably disc shaped forming a rim projecting from an outer surface of the shaft that is larger in radial direction than in axial direction. The rings 5 keep material from becoming stuck between a star 11 and an adjacent shaft. body, 9, 10 by filling up the gap between that star 11 and the adjacent shaft body 9, 10. Moreover, even if an item is forced between a star 11 and an adjacent ring 25, it tends to escape more easily, because of the space left axially aside of the ring 25 and the tendency of a star member 21 to be deflected laterally (i.e. axially) in response to an item clamped between a star 11 and a ring 25, when the clamped item can tilt laterally away from between the star 11 and the ring 25.

The rings 25 each have an uneven outer contour, which further reduces the risk of damage to the stars 11, since items that enter between one of the rings 25 and an adjacent one of the stars 11 can slip into a smaller diameter portion of the uneven outer contour. For providing this effect while not forming sharp edges that could impart traction upon a particle entraining that particle between the ring 25 and the adjacent star 11 at the side of the ring 25 moving downwards, the uneven outer contour is an undulating outer contour.

Within the framework of the invention as defined by the claims many other embodiments than the examples shown and discussed are conceivable. For instance, not all the stars of a shaft, and not all the shafts of an apparatus need to be equipped with a plurality of circumferentially distributed star member connectors and not all the stars need to have separate star members that are individually and detachably mounted to one of the star member connectors. For instance one or more of the shafts may be of a conventional design and of a shaft, one or more of the stars may be of a conventional design. This may be advantageous in areas of a sorting screen that are less susceptible to damage. Also, modifications can be made in the dimensions of the stars to satisfy the screening of the type of material being processed.

The invention claimed is:

1. A shaft for a rotary star screen apparatus, said shaft having:

a shaft body having a series of axially spaced star connectors; and a series of stars, mounted to said star connectors, each one of said stars comprising a plurality of circumferentially distributed star members each elongate in a direction having a component radially away from said shaft body;

wherein said star connectors each comprise a plurality of circumferentially distributed star member connectors; and wherein each of said star members is a separate part, individually and detachably mounted to one of said star member connectors.

2. The shaft according to claim 1, wherein each of said star members has an inner end directly adjacent to said shaft body.

3. The shaft according to claim 2, wherein spacings between circumferentially successive ones of said star members extend between said circumferentially successive ones of said star members until said shaft body.

4. The shaft according to claim 1, wherein said star members are each of elastomeric material.

5. The shaft according to claim 1, wherein the shaft body is a hollow tube.

6. The shaft according to claim 2, wherein the shaft body is a hollow tube.

7. A rotary star screen apparatus comprising a screen formed by a co-rotating and spaced parallel plurality of shafts, each of said shafts having:

a shaft body having a series of axially spaced star connectors; and a series of stars, mounted to said star connectors, each one of said stars comprising a plurality of circumferentially distributed star members each elongate in a direction having a component radially away from said shaft body;

wherein the shafts form a row of shafts, the row being oriented in a direction transverse to said shafts, a rotary contour of at least one star of each of said shafts interleaving in partial overlap with rotary contours of stars of at least one neighboring one of said shafts;

wherein said star connectors each comprise a plurality of circumferentially distributed star member connectors; and wherein each of said star members is a separate part, individually and detachably mounted to one of said star member connectors.

8. The apparatus according to claim 7, wherein each of said shafts further comprises a ring projecting radially from said shaft and encircling said shaft, said rings each being positioned coplanar with a rotary contour of at least one star of a neighboring one of said shafts.

9. The apparatus according to claim 8, wherein said rings have an uneven outer contour.

10. The apparatus according to claim 9, wherein the uneven outer contour is an undulating outer contour.

11. The apparatus according to claim 8, wherein each of said star members has an inner end directly adjacent to said shaft body.

12. The apparatus according to claim 8, wherein the shaft body is a hollow tube.

13. The apparatus according to claim 11, wherein the shaft body is a hollow tube.

* * * * *